US005848110A

United States Patent [19]

Maenchen et al.

[11] Patent Number: 5,848,110

[45] Date of Patent: Dec. 8, 1998

[54] METHOD AND APPARATUS FOR TRANSMUTATION OF ATOMIC NUCLEI

[75] Inventors: John Eric Maenchen; Carlos Leon Ruiz, both of Albuquerque, N. Mex.

[73] Assignee: Sandia Corporation, Albuquerque, N. Mex.

[21] Appl. No.: 966,457

[22] Filed: Nov. 7, 1997

Related U.S. Application Data

[62] Division of Ser. No. 603,772, Feb. 20, 1996, Pat. No. 5,764,715.

[51] Int. Cl.[6] ..... G21G 1/10

[52] U.S. Cl. ..... 376/201; 376/186; 376/111

[58] Field of Search ..... 376/108, 111, 376/114, 115, 186, 190, 194, 195, 196, 198, 199, 201; 250/423 R, 492.1, 492.2, 492.21, 492.3

[56] References Cited

U.S. PATENT DOCUMENTS

| | | | |
|---|---|---|---|
| 2,964,634 | 12/1960 | Harris | 376/111 |
| 5,473,165 | 12/1995 | Stinnett et al. | 250/492.21 |
| 5,525,805 | 6/1996 | Greenly | 250/423 R |
| 5,532,495 | 7/1996 | Bloomquist et al. | 250/492.21 |
| 5,656,819 | 8/1997 | Greenly | 250/423 R |

*Primary Examiner*—Daniel D. Wasil
*Attorney, Agent, or Firm*—V. Gerald Grafe

[57] ABSTRACT

Insuring a constant supply of radioisotopes is of great importance to medicine and industry. This invention addresses this problem, and helps to solve it by introducing a new apparatus for transmutation of isotopes which enables swift and flexible production on demand.

21 Claims, 6 Drawing Sheets

METHOD AND APPARATUS FOR TRANSMUTATION OF ATOMIC NUCLEI

This is a Divisional of application Ser. No. 08/603,772 filed on Feb. 20, 1996, now U.S. Pat. No. 5,764,715.

This invention was made with Government support under Contract DE-AC04-94AL85000 awarded by the Department of Energy. The Government has certain rights in the invention.

BACKGROUND

This invention relates to the transmutation of atomic nuclei. More particularly, it relates to the use of high intensity, repetitively pulsed ion beams to achieve the transmutation.

This invention primarily addresses the general problem of transmutation of atomic nuclei for industrial and medical purposes. In particular, the current invention allows production of commercially important quantities of radioisotopes in small facilities whose capital and production costs per curie of product isotope are below those of isotope production either in conventional particle accelerators or in nuclear reactors. Additionally, the current invention allows manufacture of a specific isotope with minimal production of radioactive waste.

There is a national and international need for the reliable, year-round, and economically competitive production of radionuclides for a wide variety of applications including nuclear medicine, nutrition studies, agriculture, environmental studies, genetic research, molecular biology, pharmacology, drug development, geology, manufacturing, and industrial calibration and testing.

The nature of a transmutation reaction is that a target nucleus interacts with a bombarding particle, forming an energetic compound nucleus, which then decays into the desired product isotope through emission of elementary particles, low atomic number nuclei, and/or gamma rays. Most isotopes can be created via multiple transmutation paths, with the most desirable path generally being that which requires the smallest interaction energy. If the bombarding particle has more than this minimum kinetic energy, a number of reaction channels will typically be available for the decay of the intermediate nucleus, so that a range of isotopes including the desired one are generally produced. The concentration of useful isotopes increases asymptotically to a 'saturation activity' (described below) as the target materials are bombarded for a period of time on the order of several isotope decay half-lives.

At this point, the product isotopes must be chemically and/or isotopically separated into the pure products. The time required for the separation process can be a problem for radioisotopes having short half-lives, as significant amounts of the desired product can decay. This reduces the activity of the desired product isotope and, at times, poisons that isotope with undesired decay products which accumulate during the process of separation. Transmutation processes in which the kinetic energy of the bombarding species is sufficient to produce multiple isotopes can also generate radioactive waste which must be disposed of, at high financial and environmental cost.

At present, isotope production is predominantly divided into two major categories. Nuclear reactors can produce a wide range of isotopes through interaction of materials with the thermal neutron flux (typically~$10^{13}$ neutrons/cm$^2$/second), either through bombardment of samples introduced into the reactor or through mining the fission products when the fuel elements are replaced. Short lifetime isotopes are generally produced through bombardment of samples, owing to the lengthy process required to extract individual isotopes from used fuel elements. However, exposure to a fixed neutron irradiation environment typically leads to creation of a range of radioisotopes which require extensive chemical separation for use. Many mixes of isotopes cannot be separated using chemical techniques, and therefore are not made available using this technique. The cost of obtaining pure isotopes from reactors is thus often very high. The major hidden costs of radioisotope production in nuclear reactors include the real cost of development and retirement of the nuclear reactor and disposal of the mixed transuranic and fission product wastes, whose ultimate cost is very difficult to estimate.

Particle accelerators are the second category which can produce radioisotopes through direct interaction of energetic particles with atomic nuclei in a target. At present, accelerators known in the art for production of radioisotopes include linear accelerators (LINACs) and cyclotrons, both of which produce small currents (typically $\mu$amps to ~1 mamp) of intermediate to high kinetic energy (5 to 100 MeV) charged particles. The use of highly energetic particles (i.e., particles having high kinetic energy) offsets to some extent the low currents available from conventional accelerators by producing more reactions per unit beam current, or equivalently, by producing higher yield. However, unwanted reaction channels are simultaneously opened, resulting in production of a complex mix of isotopes other than the desired product. As a result of the opening of competing channels, the cross section of the desired product may actually go down at sufficiently high kinetic energy of the bombarding ion. Since unwanted isotopes are also produced with highly energetic ions, there is a significant cost in isotopic separation as well as in disposal of radioactive waste required with conventional accelerator-based techniques.

The isotopes presently available in the market are those which can be economically synthesized from these sources, the selection being limited by the transmutation yield, the half life of the product isotope, the available irradiation current or neutron flux, and the capital, production, and retirement costs of the irradiation source. When the product isotope is radioactive, some of the output will decay as more is being produced. If the production rate of the isotope remains constant, eventually the target reaches an equilibrium level of activity where the rate of production of new isotope equals the rate of decay of old isotope. This is called the saturation activity, since further irradiation will not increase the amount of the desired isotope in the target.

Saturation activity is a useful metric for production of unstable isotopes. The saturation activity scales with the production rate, which is the transmutation yield per particle times the irradiating beam current $I_b$ (measured in incident particles per second). The transmutation yield per particle is proportional to the reaction cross-section and to the range of the incoming ion in the target material. The saturation activity of a given radioactive product is substantially attained through irradiation of a sample for a few decay half-lives of that product, at which point the decay rate is roughly equal to the production rate. The amount of radioisotope producing the saturation activity is about twice the saturation activity divided by the half-life of the isotope.

The cross section of most accelerator-produced nuclear reactions increases sharply with particle kinetic energy after the kinetic energy passes a well-defined threshold, then peaks at a kinetic energy characteristic of the reaction, generally falling off rapidly at larger kinetic energies due to competition from other reactions with high threshold kinetic energies. If the incident particle is singly charged, the coulomb interaction with the nucleus of the target nucleus leads to a threshold kinetic energy typically of 6 MeV. This is required to overcome the electromagnetic repulsion until the particle and the nucleus are close enough for the strong force to overwhelm the coulomb repulsion and form the compound nucleus. The coulomb barrier increases in energy roughly linearly with the charge of the bombarding particle. For example, α particles (completely ionized $^{4}$He atoms) have a nuclear charge of 2, and the threshold for many a induced nuclear reactions is usually about 12 MeV.

One exception to this rule of thumb is deuteron reactions. The proton and the neutron in the deuteron are not strongly bound (binding energy of 2.23 MeV). As a result, it is possible for a deuteron to approach a nucleus at a kinetic energy of, say 3 MeV, for the proton to be split off from the deuteron by coulomb interaction with the target nucleus, and then for the remaining neutron, which is uncharged, to penetrate the target nucleus. As a result, reactions such as (d,p) reactions (the notation means deuteron in, proton out) can occur at threshold kinetic energies on the order of 2–2.5 MeV, rather than the 6 MeV expected for, e.g., (p,n) reactions.

The magnitude of the cross section for nuclear reactions is the primary fundamental factor controlling nuclear transmutation. The cross section, measured in barns (1 barn=$10^{-24}$ cm$^{2}$), is the effective size of the target nucleus for a particular reaction at a given energy. The maximum cross section for simple nuclear reactions (those involving p, d, α, and 1 or 2 n) is generally in the range 0.05 to ~1 barn. There are exceptions, primarily due to resonances in the compound nucleus, but these numbers are a good general guideline. Such resonances, however, can greatly increase the cross-section of a near-threshold reaction compared to the expected value, and thus can be of considerable importance for transmutation which occurs in this regime.

Using the above information the transmutation yield can be estimated. Consider the reaction $^{65}$CU (p,n) $^{65}$Zn, which has a maximum reaction cross section of about 1 barn for 10 MeV protons. The saturation activity for a typical 10 μamp accelerator is ~$1.2\times10^{11}$ decays per second, or about 3.2 curies. However, $^{65}$Zn is a positron emitter with a half-life of about 244 days, or about $2\times10^{7}$ seconds. It would take several half-lives of irradiation to approach the saturation activity, an impractical commitment of equipment. In a single day, some 0.01 curies would be generated, an amount useful for tracer experiments, but insufficient for many other biomedical and industrial applications.

Conventional low energy (<5 MeV per nuclear charge) accelerators are limited to rather low beam currents (usually sub-milliamp). As a result, their ability to produce isotopes is rather limited, especially short-lived isotopes. In order to increase the transmutation yield, higher beam kinetic energies are commonly used. The use of higher beam kinetic energies will eventually activate competing reactions, resulting in a smaller cross section for the desired reaction. Especially troublesome is the generation of highly excited intermediate nuclei which evaporate neutrons to remove their excess energy. However, the range of the particles, and thus the number of potential transmutation encounters, increases rapidly with beam energy. If the previous example had used 100 MeV protons, for example, the range above threshold would have been about 50 times greater. Given a constant reaction cross-section (which is not the case), the production rate of $^{65}$Zn would be about 50 times greater, with only 10 times more energy invested.

At first glance, the use of higher beam kinetic energies seems to be a useful technique (indeed, it is the standard technique used for production of radioisotopes by accelerator-based methods). Unfortunately, although the total cross section for proton-copper collisions remains high (~1.5 barns) at 100 MeV, the cross section for the desired (p,n) reaction falls to about 0.015 barns. The problem is that there is so much energy in the intermediate nucleus that many competing reactions become possible. Some examples followed by their approximate cross-sections at 100 MeV and their half-life are:

| | | | |
|---|---|---|---|
| $^{65}$Cu (p,n) $^{65}$Zn | .015 barn | 244 days | (desired reaction) |
| $^{65}$Cu (p,2n) $^{64}$Zn | .035 barn | Stable | |
| $^{65}$Cu (p,pn) $^{64}$Cu | .150 barn | 12.9 hours | |
| $^{65}$Cu (p,α) $^{62}$Ni | <<.1 barn | Stable | |

A host of other reactions are present at this energy. Perhaps foremost are reactions in which additional neutrons are 'evaporated' by the high degree of excitation of the intermediate nucleus. Such neutron-poor products as $^{62}$Zn (9.3 hours), $^{61}$Cu (3.3 hours), $^{57}$Ni (36 hours), $^{60}$Co (5.2 years), $^{57}$Co (272 days), and $^{56}$Co (77 days) with reaction cross-sections in the 1–100 millibarn range are seen when natural copper is bombarded by protons in the 10–100 MeV range. This competition of other reactions with the desired reaction path both reduces the yield of the desired reaction and clutters the target with a range of unwanted isotopes.

The plateau yield of $^{65}$Zn from the (p,n) reaction on $^{65}$Cu is approached at a proton kinetic energy of about 30 MeV. Higher proton kinetic energy contributes little additional yield because the cross-section for this reaction falls more rapidly than the range of the proton increases with the additional beam kinetic energy. At this beam kinetic energy, however, many other unwanted reactions also exhibit significant yield. For example, roughly as much $^{64}$Cu and $^{64}$Zn will be produced as $^{65}$Zn when a $^{65}$Cu target is bombarded with 30 MeV protons. In addition, this level of kinetic energy activates reactions in which the compound nucleus evaporates neutrons, leading to significant yields of, e.g., $^{63}$Zn (p,3n), $^{62}$Zn (p,4n), and $^{62}$Cu (p,p3n). The neutrons which are emitted in such reactions have the potential for reacting with the target material, resulting in (n,γ), (n,2n), and (n,p) reactions, thereby producing additional unwanted radioisotopes. These neutrons can also escape from the target material and make portions of the accelerator apparatus radioactive, posing health physics problems. Thus, even though a beam kinetic energy of 30 MeV maximizes $^{65}$Zn production via the (p,n) process from $^{65}$Cu, extensive production of other isotopes and other side effects suggest that the most practical approach for improving the production yield for a specific reaction may not be simply to increase the kinetic energy of the bombarding particles.

Many of the problems concerning the production of unwanted isotopes and the radioactivation side effects are absent or less important when lower beam kinetic energy is used for transmutation processes. However, at lower beam kinetic energy, the limited currents available in conventional accelerators seriously limits their ability to serve present commercial markets. An important goal is thus to produce low voltage (~10 MeV) accelerators having beam currents at least 2–3 orders of magnitude greater than conventional accelerators (thus on the order of 100 milliamps or more).

The problem of nucleosynthesis of $^{99}$Mo is used to illustrate the concerns and problems which lead to selection of a reaction path for use. $^{99m}$Tc is perhaps the most important radioisotope presently used for medical imaging purposes. $^{99m}$Tc is a short-lived (6 hour half-life) decay product of $^{99}$Mo, produced when $^{99}$Mo undergoes $\beta^-$decay (half-life 67 hours). In practice, $^{99m}$Tc is separated and prepared for use by selective elution from a $^{99}$Mo-charged generator. (The generator is essentially a chromatographic column.) The half-life of $^{99}$Mo is short enough that replacement of the generator elements on roughly a weekly basis is required.

$^{99}$Mo is now supplied by a foreign firm by separation from fission products. There is a hidden cost of unknown magnitude associated with the use of nuclear reactors to manufacture radioisotopes, which is economic, societal, environmental, and political in nature. In addition, the importance of this radioisotope for medical diagnostics makes dependence on a foreign source prone to risk, from potential logistical and political shutdown of production and/or import to the United States. Accordingly, creating a domestic accelerator-based source of $^{99}$Mo is an important goal.

The use of conventional accelerators to service the need for $^{99m}$Tc, however, presents a difficult problem of scale. An analysis of radioisotope usage suggests a total U.S. need for roughly 150,000 curies per year of $^{99m}$Tc, which, counting manufacturing, delivery, and usage delays, requires manufacture of approximately 2.25 megacuries per year of $^{99}$Mo. The present cost is about $15/curie, giving a national market of some $34M/yr.

What concerns enter into choice of a transmutation reaction for $^{99}$Mo? The most essential factors are cross-section of the proposed reaction, range of the beam particles in the target material, and the absence or unimportance of competing reactions. Potential reactions for production of $^{99}$Mo include the $^{98}$Mo (d,p) $^{99}$Mo reaction, having a cross section of about 0.25 barns at 15 MeV, the $^{96}$Zr ($\alpha$,n) $^{99}$Mo reaction, which has a cross section of about 0.3 barns at 20 MeV, and the $^{100}$Mo (p,pn) $^{99}$Mo reaction, which has a cross section of about 0.1 barns at 20 MeV. All these reactions have reasonable cross-sections for isotopic production.

The largest cross-section for production of $^{99}$Mo is provided by the ($\alpha$,n) reaction from $^{96}$Zr. Significant competing reactions include the ($\alpha$,2n) reaction, having a cross-section of about 0.5 barns, and the ($\alpha$,p) reaction, having a cross-section of about 0.2 barns. However, the ($\alpha$,2n) reaction produces a stable isotope of Mo, so presents no difficulty. The ($\alpha$,p) reaction gives $^{99}$Nb, which has a short half-life (2.5 min), and can be allowed to decay away, forming $^{99}$Mo, the desired product. These competing reactions thus increase the effective cross-section for production of $^{99}$Mo from $^{96}$Zr through an ($\alpha$,x) reaction to about 0.5 barns. Unfortunately, the reduced range of the a particles in the target compared to either protons or deuterons makes the total transmutation yield perhaps a factor of ten smaller at a given particle kinetic energy.

The $^{98}$Mo (d,p) $^{99}$Mo reaction offers the next largest cross-section. There are again competing reactions, which fortunately do not seriously affect the desired result. The (d,n) reaction, with a cross-section of about 0.15 barn at 15 MeV beam kinetic energy gives $^{99m}$Tc. This is the ultimate end product of the process, and has a short enough half-life that it will essentially disappear from the target by the time it is delivered to the point of use. The (d,2n) reaction, with a cross-section of about 0.7 barns at 15 MeV beam kinetic energy gives $^{98}$Tc. As $^{98}$Tc has a half-life of about $1.5\times10^6$ years, its influence can be ignored in any application of $^{99}$Tc. There will be other reactions, but their cross sections will be very small owing to the low beam energy.

The $^{100}$Mo (p,pn) $^{99}$Mo reaction is overwhelmed by competing (p,n) and (p,2n) reactions which produce $^{100}$Tc and $^{99}$Tc, respectively. As $^{100}$Tc has a half-life of 17 seconds, and decays into $^{100}$Ru (a stable isotope), it causes no problem. Also, since $^{99}$Tc is the ultimate desired product, its production is not a problem. The problem with the (p,pn) reaction is the small cross-section. A cross-section of 0.1 barn requires a 20 MeV proton beam, whereas the $^{98}$Mo (d,p) $^{99}$Mo reaction produces a larger cross-section of 0.25 barn at a beam energy of only 15 MeV. Even when the larger range of a 20 MeV proton beam in the target is considered, the $^{98}$Mo (d,p) $^{99}$Mo reaction is considerable more energy-efficient, producing about twice the product for a given integrated beam energy. The preferred transmutation reaction thus appears to be the $^{98}$Mo (d,p) $^{99}$Mo reaction.

There is yet another concern in choice of transmutation reaction which is well illustrated by the $^{98}$Mo (d,p) $^{99}$Mo reaction. Mo has 7 naturally occurring stable isotopes, having abundances ranging from ~9% to 24% ($^{98}$Mo). Irradiation of natural Mo results in a large number of undesired radioisotopes having transmutation yields and half-lives similar to the desired product, but having much higher gamma energies. The worst offenders include $^{91}$Nb, $^{95}$Nb, and $^{96}$Nb, which have half-lives on the order of days to weeks, and gamma energies of about 1 Mev compared to the 0.14 MeV gammas of $^{99m}$Tc. Simple dilution of $^{98}$Mo in natural Mo also reduces the yield of $^{99}$Mo by about a factor of four.

To avoid the additional processing and handling steps required by the use of natural Mo targets in the production of $^{99}$Mo, and to avoid the effects of target dilution, the preferred modality is use of a target enriched in $^{98}$Mo. Use of such an enriched target avoids production of unwanted radioisotopes from the other Mo isotopes, and increases the $^{99}$Mo yield by a factor of four. Enriched targets are expensive, but as very little of their material is actually transmuted in a given production cycle, targets can be reused almost indefinitely.

The activity of a target subjected to a given intensity of irradiation is nearly at the level of the saturation activity after irradiation for two half-lives of the desired isotope, in this case $^{99}$Mo. The saturation activity must average ~40000 curies, this amount to be produced approximately weekly, to supply the national need for $^{99}$Mo.

40000 curies of radioisotope has a decay rate of 1.6×1015 per second. Given an accelerator capable of generating a 15 MeV beam of deuterons with an average current of 100 ma, the target activity initially increases at a rate of about 0.016 curies/second of irradiation. A week's production would amount to about 11000 curies of product. Estimates suggest that the cost of such product material will be about $5–10/curie, a cost considerably less than the current techniques of nuclear waste mining, especially when the unknown birth to death costs of waste disposal are included. Given a national need of $2.25\times10^6$ curies per year, about five machines of the type described above applied to full-time production of $^{99}$Mo will meet national needs. This capability turns a major problem of supply into a relatively small-scale operation.

Another example of a radionuclide which might profitably be produced using an accelerator-based system generating high beam currents at low beam voltages is $^{123}$I. $^{123}$I is primarily used in cancer treatment, where the destructive influence of its very soft gamma rays (E~0.1 MeV) can be effectively limited to the immediate region of a tumor. It has a short half-life (~13 hours), which adds to the overall safety of use (activity is essentially gone in a matter of days, making the waste problem much easier). Roughly 20 milliCuries are required for an individual treatment, and, assuming that 10% of new cancer cases are appropriate for this form of treatment, the national requirement for $^{123}$I is on the order of 50000 curies per year. (A factor for loss to decay between production and use has been included.) It is nearly impossible to make significant amounts of $^{123}$I by thermal neutron irradiation of a target material or by mining fission products, because it is very neutron-poor. Accordingly, the only real possibility for servicing this need is accelerator-based transmutation.

A preferred approach toward production of $^{123}$I is to irradiate a target of enriched tellurium $^{122}$ (natural abundance ~2.5%) with a ~15 MeV deuteron beam, driving the reaction $^{122}$Te (d,n) $^{123}$I, which has a cross-section of about 0.1 barn. Enrichment of the target material is required because tellurium has 8 nearly-stable isotopes. Irradiation of a target of natural Te would lead to a wide variety of product isotopes, and the short half-life of $^{123}$I precludes use of conventional isotopic separation techniques. Using a target of enriched $^{122}$Te eliminates the need for extensive separation procedures.

Competing reactions do exist, of course. For example, the (d,2n) reaction, which produces $^{122}$I, has a cross-section of about 0.4 barn. However, $^{122}$I has a half-life of only 3.5 minutes, and emits a positron, producing $^{122}$Te, which is the original target material. One also expects the (d,γ) reaction to give a small amount of $^{124}$I, which is an undesired product, but this can be minimized by suitable choice of irradiation energy.

A high beam current (15 MeV, 100 ma) accelerator would produce some 250 curies of $^{123}$I in nearly isotopically pure form per day. Supplying national needs would thus require some 150 days of operation per year, costing about $2.0M plus the cost of the enriched targets, or about $3 per treatment. (Note that the enriched targets can again be reused almost indefinitely.)

The need to manufacture a wide variety of pure radioisotopes in commercial quantities for a broad spectrum of medical and industrial purposes requires a new view toward the approaches used. Apparatus and methods capable of producing a wide range of radioisotopes with as much specificity as possible is needed. Rapid, high-yield transmutation is also required to serve commercial demands for large quantities of short-lived radioisotopes. Finally, a transmutation technique which generates a minimum of radioactive waste is needed.

SUMMARY

The present invention addresses the problems outlined above. An accelerator based on a combination of a high repetition rate high energy pulsed power supply (RHEPP) and a magnetically-injected anode plasma (MAP) source diode is used to provide pulsed particle beams having intermediate energy (0.2–20 MeV) and average power levels of hundreds of kilowatts to megawatts. This will increase the rate of isotopic production by 2–3 orders of magnitude over processes based on conventional accelerators. Any gaseous ion can be accelerated with this technology (proton, deuteron, and helium beams are of special interest). This capability can be applied to transmute target nuclei selectively into desired isotopes. RHEPP/MAP accelerators are also extremely power efficient and relatively small in size, making application of small units practical in, for example, major local or regional medical facilities. Finally, the use of relatively low beam particle energies reduces or eliminates the problem of undesired products and the subsequent generation of radioactive waste. Although the invention is being discussed in terms of embodiment via the RHEPP/MAP system, any pulsed ion beam generator having sufficient ion kinetic energy and total average beam current can be used in the same manner. Numerous embodiments and other features, aspects, and advantages of the present invention will become better understood with reference to the following description and appended claims.

BRIEF DESCRIPTION OF THE DRAWINGS

The present invention will become more fully understood from the detailed description given herein and the accompanying drawings which are given by way of illustration only, and thus do not limit the present invention. In particular, FIGS. 1–3 describe an RHEPP/MAP rapidly repeating pulsed ion accelerator, comprising a Repetitive High Energy Pulsed Power (RHEPP) power source and a Magnetically-confined Anode Plasma (MAP) ion source. However, the detailed description of the RHEPP/MAP accelerator herein is not intended to exclude the use of alternate apparatus having similar operating parameters in the transmutation process.

DESCRIPTION

Figure 1:
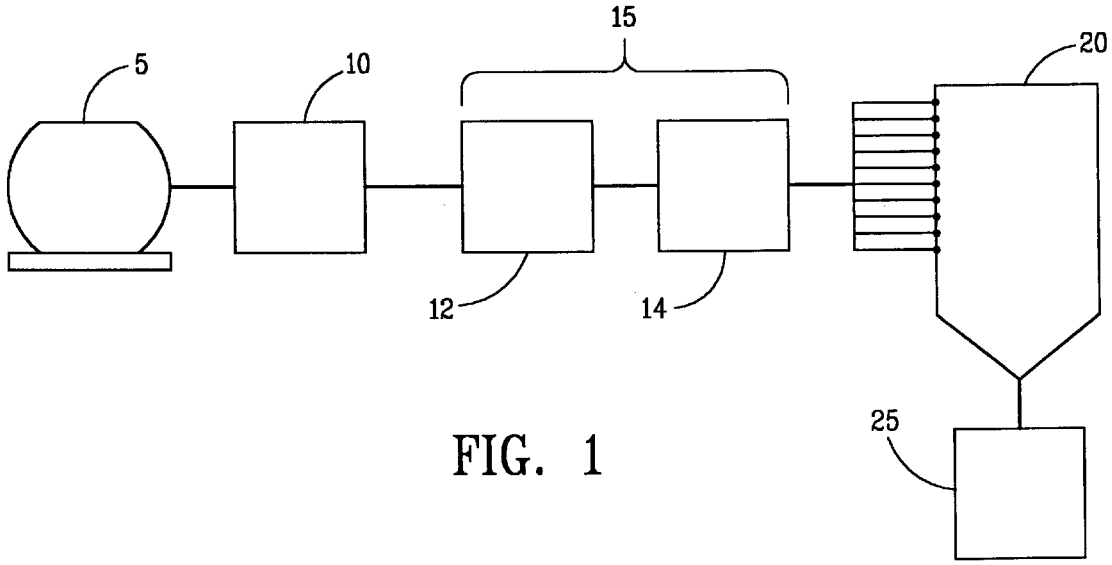
FIG. 1 is a schematic of the RHEPP pulsed power system.

The following discussion is a description of a RHEPP/MAP rapidly repetitive pulsed ion beam system which can be utilized to produce the ion beams for transmutation of atomic nuclei. (A system of this type is described in patent application Ser. No. 08/153,248, filed Nov. 11, 1993, now U.S. Pat. No. 5,473,165. Note, however, that the transmutation techniques which are the focus of the present invention do not depend upon any particular pulsed ion source, pulsed power supply, or accelerator design. This system has two major subsystems, the RHEPP pulsed power source and the MAP ion diode.

State-of-the-art ion beam generators are typically "one shot" devices, i.e., they operate at low repetition rates (<<1 HIz). Existing ion beam generators cannot be operated at high repetition rates (>>1 Hz) for a number of reasons. First, existing pulsed power supplies are not able to generate electrical pulses at high repetition rates having the voltage, pulse width (i.e., nominal temporal duration), and pulse energy required to generate the ion beams needed for the various beneficial applications described herein. This limitation renders commercial exploitation impractical. Second, the design of existing ion beam generators does not allow repetitive operation for an extended number of operating cycles (>>$10^3$) without replacement of major components. This limitation would require a maintenance time-manufacturing time ratio incompatible with routine manufacturing operations. Third, existing ion beam generators generally operate with electrical efficiencies <5%, thus presenting major challenges to the pulsed power supply and the cooling system of the generator. These limitations and others have made it impossible to routinely utilize the conventional pulsed ion beam technology described above for accelerator-based transmutation techniques.

MAP (Magnetically-confined Anode Plasma) ion sources are particularly interesting because of their ability to shield the ion source structure from the destructive effects of the ion beam by the magnetic structure of the MAP ion source. The MAP ion diode magnetic fields are designed to have a profile such that the separatrix (B=0) between the fast coil field and the slow coil field is located near the anode to minimize or eliminate ion beam rotation. The gas nozzle is designed to produce a high mach number (supersonic) gas flow rate to efficiently localize the gas puff introduced into the ionizing region proximate the fast coil. Means are also provided to create an adjustable bias field to control the formation position of the plasma. A fast ringing field is imposed on the gas puff as it is delivered to the ionizing region to pre-ionize the gas. These functions contribute to making the MAP ion beam source practical for large-scale industrial operations.

The use of the MAP ion diode of this invention for pulsed ion beam transmutation requires a pulsed high power source. The detailed description below will be devoted to one such source, the Repetitive High Energy Pulsed Power (RHEPP) system developed at Sandia National Laboratories. Other rapidly repeatable pulsed high voltage high power sources could be used as they are developed.

The MAP ion diode, when combined with a repetitively pulsed power system such as the RHEPP source, yields an ion beam generator system capable of high average power and repetitive operation over an extended number of operating cycles for performing transmutation at commercially attractive costs. In particular, the ion beam generator of the present invention can produce high average power (1 kW–4 MW) pulsed ion beams at 0.1–20 MeV energies and pulse durations or lengths of from about 10 nanoseconds (ns)–2 microseconds ($\mu$s), or longer as necessary for the particular application.

A block diagram of a RHEPP power system produced according to the teachings of the present application is shown in FIG. 1. From the prime power input, several stages of magnetic pulse compression and voltage addition are used to deliver a pulsed power signal of up to 20 MV, 60 ns FWHM, 23 kJ pulses at a rate of 120 Hz to an ion beam source for this particular system, yielding an average output current of 140 milliamps. The power system converts AC power from the local power grid into a form that can be used by an ion beam source 25.

Referring to FIG. 1, in one embodiment of the invention, the power system comprises a motor 5 which drives an alternator 10. The alternator 10 delivers a signal to a pulse compression system 15 which has two subsystems, a 1 $\mu$s pulse compressor 12 and a pulse forming line 14. The pulse compression system 15 provides pulses to a linear inductive voltage adder (LIVA) 20 which delivers the pulses to the ion beam source 25.

The alternator 10 according to one embodiment is a 600 kW, 120 Hz alternator. In the unipolar mode, it provides 210 A rms at a voltage of 3200 V rms with a power factor of 0.88 to the magnetic switch pulse compressor system 15. The alternator is driven by a motor connected to the local 480V power grid.

In one embodiment, the pulse compression system 15 is separated into two subsystems, one of which is a common magnetic pulse compressor 12 composed of a plurality of stages of magnetic switches (i.e., saturable reactors) the operation of which is well known to those skilled in the art. The basic function of each of the stages is to compress the time width of and to increase the amplitude of the voltage pulse received from the proceeding stage. Since these are very low loss switches, relatively little of the power is wasted as heat, and the energy in each pulse decreases relatively little as it moves from stage to stage. These stages as developed for this system are physically quite large. In the interest of conserving space, it would be possible to replace the first few stages with appropriately designed silicon control rectifiers (SCR's) or thyratrons to accomplish the same pulse compression result.

In this embodiment, stages 12 convert the output of the alternator 10 into a 1 $\mu$s wide LC charge waveform which is then delivered to a second subsystem 14 comprising a pulse forming line (PFL) element set up in a voltage doubling Blumlein configuration. The PFL is a triaxial water insulated line that converts the input LC charge waveform to a flat-top trapezoidal pulse with a design 15 ns rise/fall time and a 60 ns FWHIM. A cross sectional view of the PFL is shown in FIG. 1B.

The pulse compression system 15 can provide unipolar, 250 kV, 15 ns rise time, 60 ns full width half maximum (FWHM), 4 kJ pulses, at a rate of 120 Hz, to the linear inductive voltage adder (LIVA) (20). In a preferred embodiment, the pulse compression system 15 should desirably have an efficiency >80% and be composed of high reliability components with very long lifetimes (~$10^9$–$10^{10}$ pulses). Magnetic switches are preferably used in all of the pulse compression stages, MS1–MS5, because they can handle very high peak powers (i.e., high voltages and currents), and because they are basically solid state devices with a long service life.

Figure 1A:
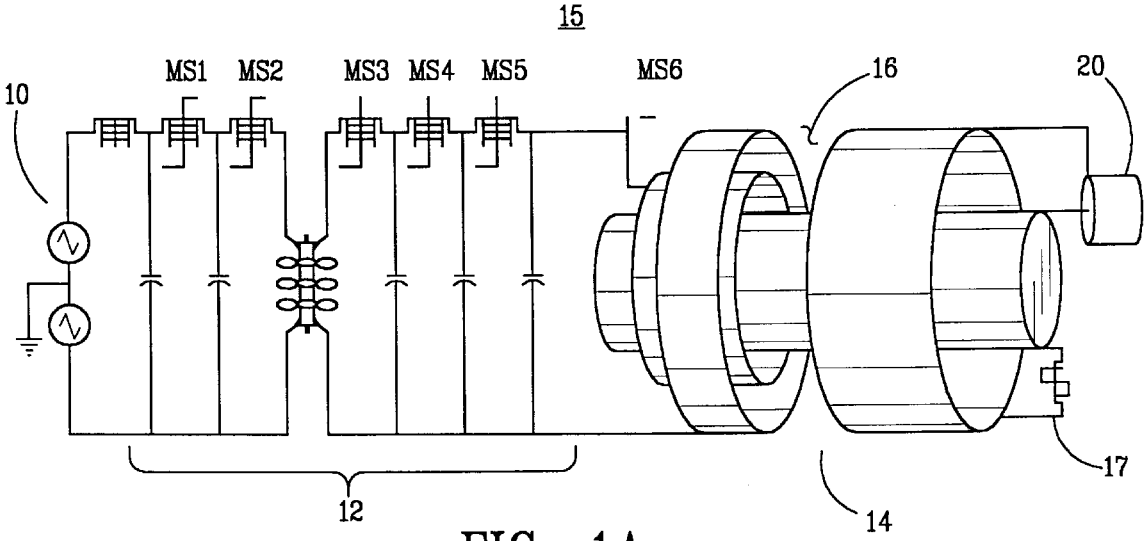
FIG. 1A is a circuit diagram of a pulse compression system 15 utilized in the pulsed power system of FIG. 1.
Figure 1B:
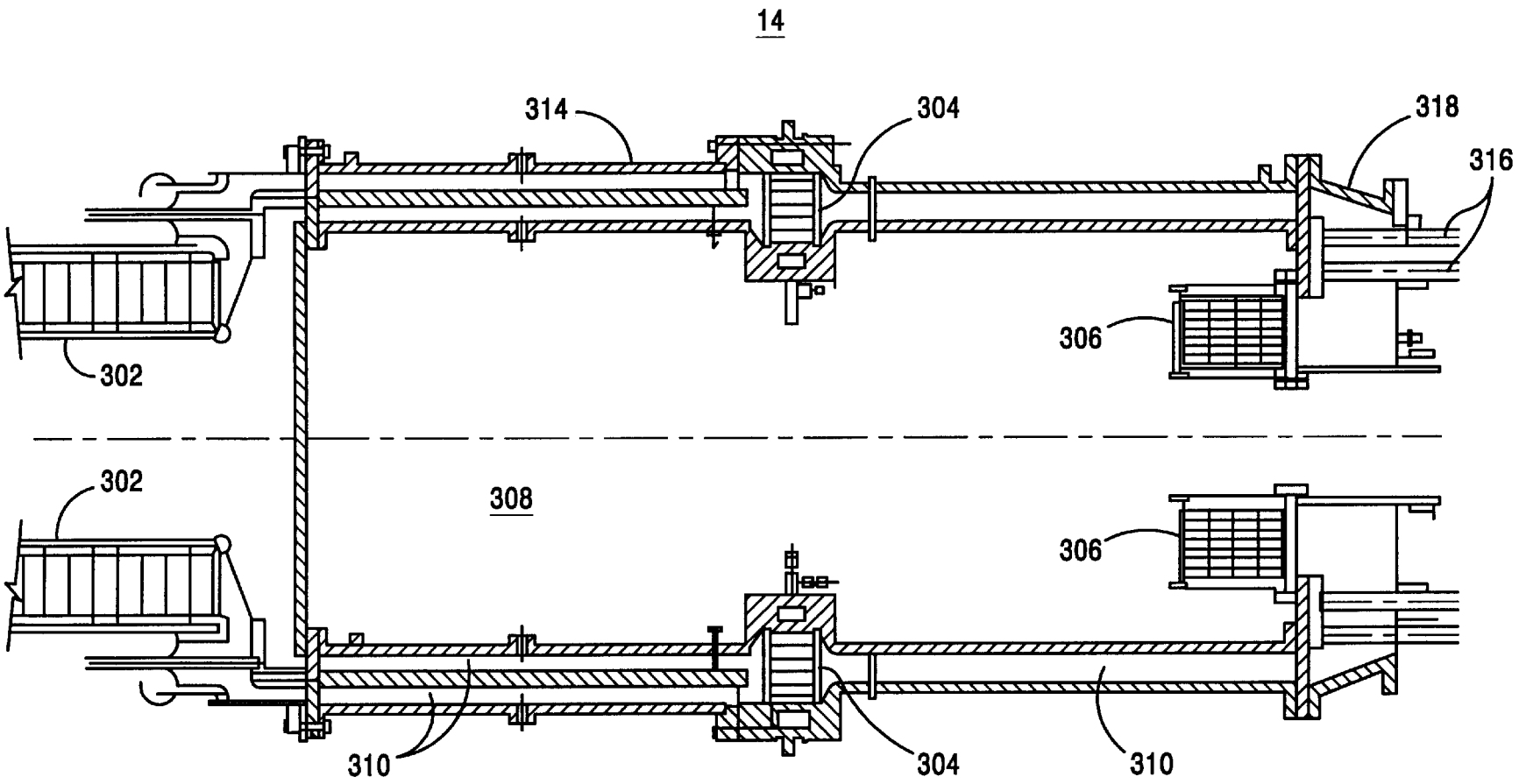
FIG. 1B is a cross-sectional view of a pulse forming line element.
Figure 1C:
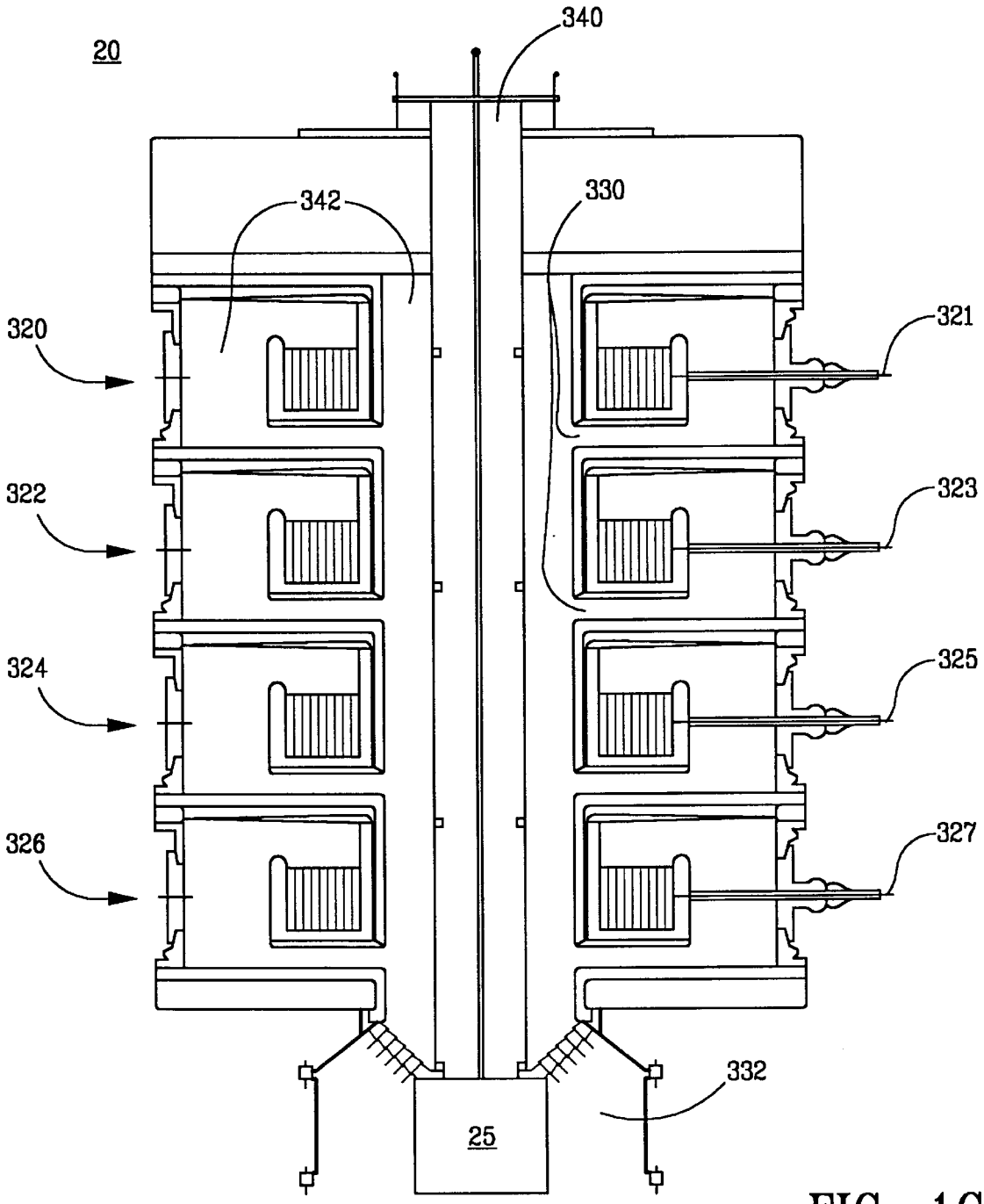
FIG. 1C is a cross-sectional view of the Linear Inductive Voltage Adder (LIVA)

The five compression stages used in this embodiment as well as the PFL 14 are shown in FIG. 1A. The power is supplied to the pulse compression system 15 from the alternator 10 and is passed through the magnetic switches, MS1–MS5, to the PFL 14. The PFL is connected to the linear induction voltage adder (LIVA) 20 described below. The second and third magnetic switches, MS2 and MS3, are separated by a step-up transformer T1 as shown. Switch MS6 is an inversion switch for the PFL.

The LIVA (20) is preferably liquid dielectric insulated. It is connected to the output of the PFL and can be configured in different numbers of stages to achieve the desired voltage for delivery to the ion beam source. The nominal output pulse of the LIVA 20 has substantially the same temporal characteristics as that provided to it by the PFL, namely, trapezoidal with 15 ns rise and fall times and 60 ns FWHM (full width half maximum). The output pulses from an arbitrary number of PFL structures can be added in a single LIVA to deliver the 10–20 MeV required for accelerator-based transmutation to a MAP diode.

Figure 2:
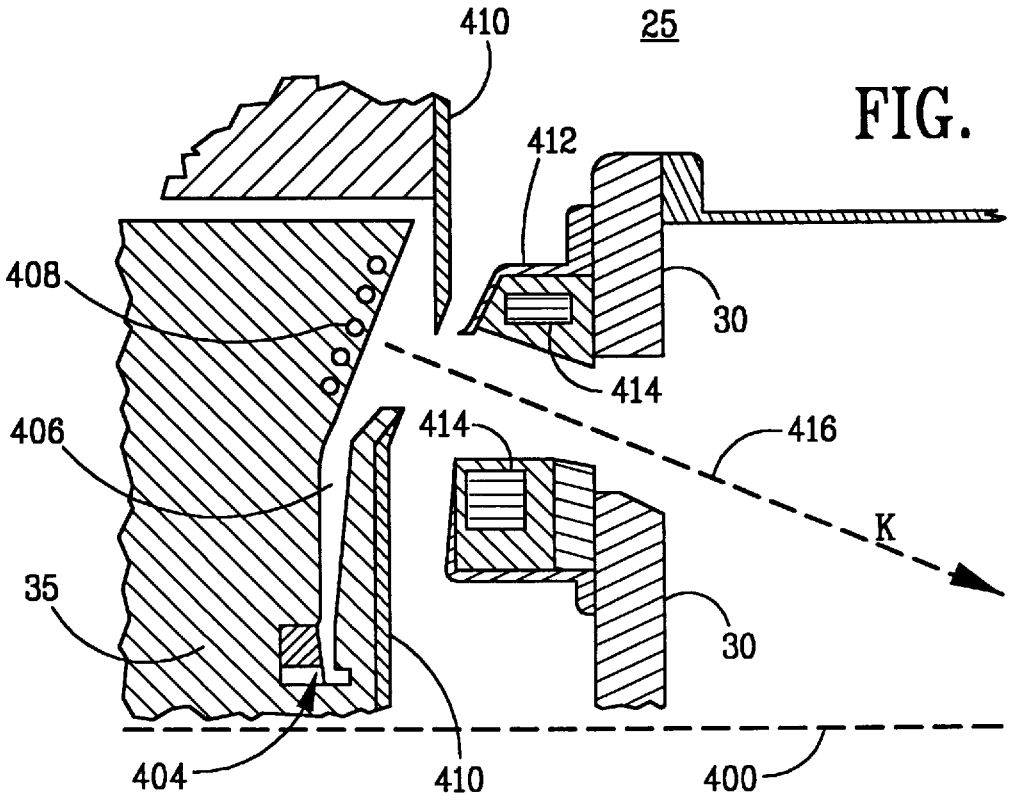
FIG. 2 is a partial cross-sectional view of the magnetically-controlled anode plasma (MAP) source 25 of the present invention.

The second component of the pulsed ion beam system is the MAP ion beam source 25, shown in FIG. 2. The MAP ion beam source is capable of operating repetitively and efficiently to utilize the pulsed power signal from the power system efficiently to turn gas phase molecules into a high energy pulsed ion beam.

Figure 2A:
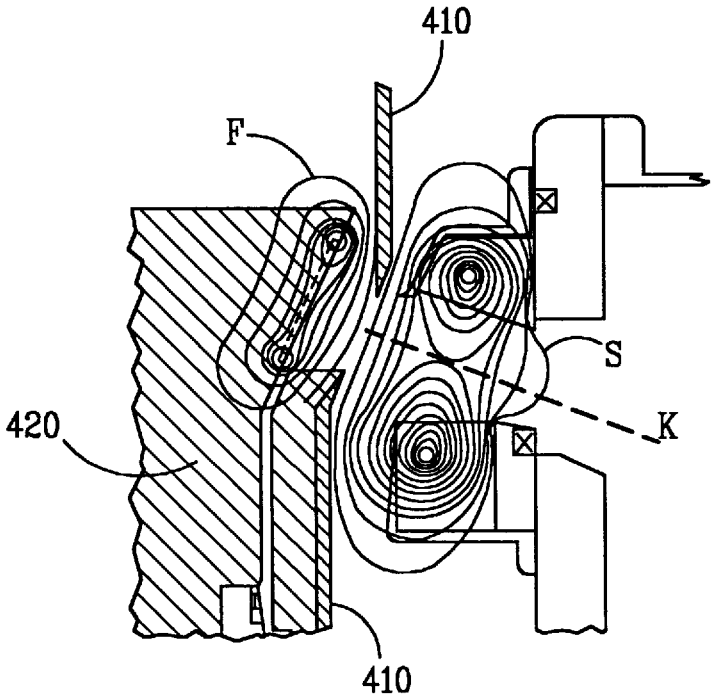
FIG. 2A is a modified version of FIG. 2 showing the magnetic field lines produced by the fast and slow coils in the MAP source'.
Figure 2B:
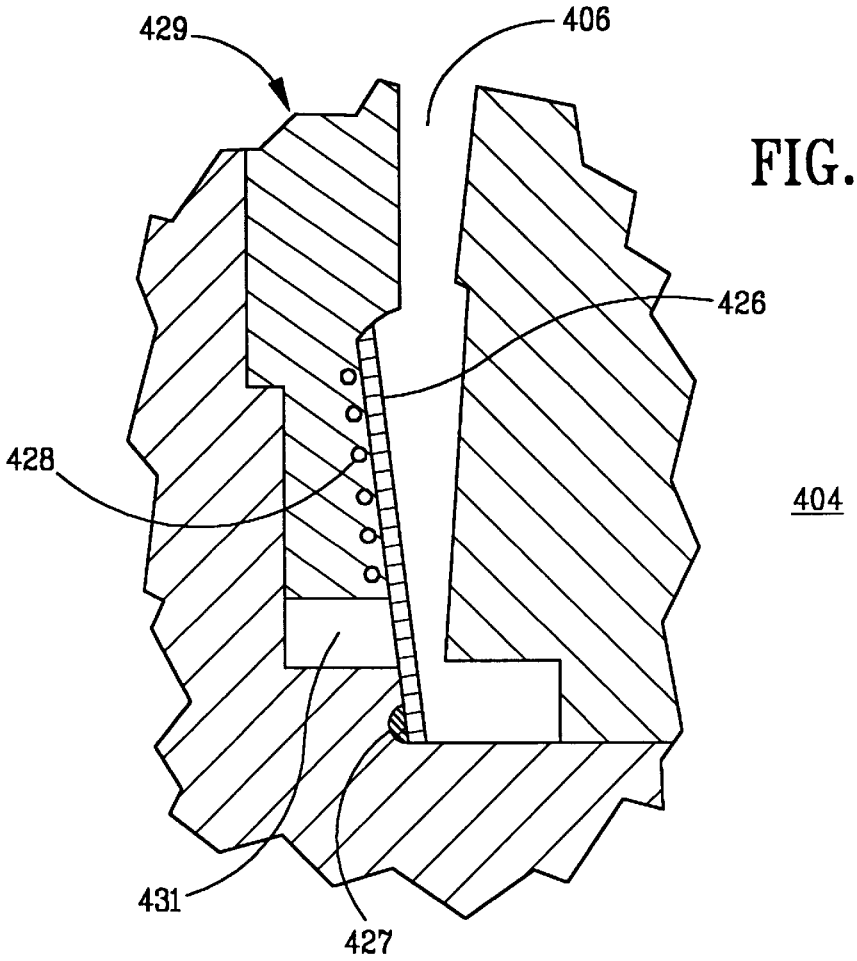
FIG. 2B is an expanded view of a portion of FIG. 2 showing the gas inlet valve and the gas inlet channel.
Figure 3:
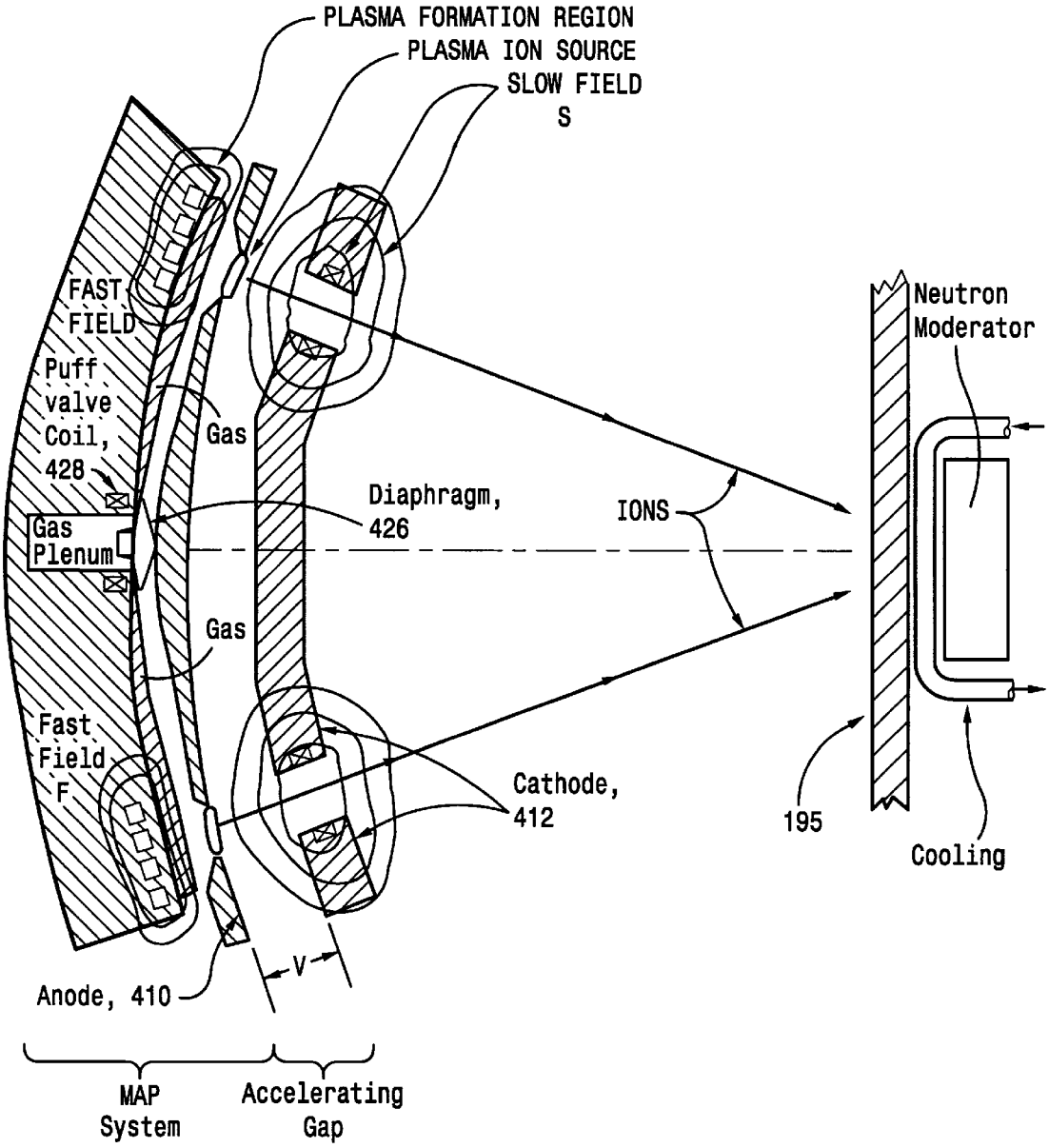
FIG. 3 is a schematic full cross-sectional view of the MAP ion diode.

The ion beam source 25 shown in FIG. 2 is a magnetically-confined anode plasma (MAP) source. FIG. 2 shows a partial cross-sectional view of one symmetric side of the ion beam or MAP source 25. The ion beam or MAP source 25 produces an annular ion beam K which can be brought to a broad focus symmetric about the axis X—X 400 shown. In the cathode electrode assembly 30 slow (1 ms rise time) magnetic field coils 414 produce magnetic flux S (as shown in FIG. 2A) which provides the magnetic insulation of the accelerating gap between the cathodes 412 and the anodes 410. The anode electrodes 410 also act as magnetic flux shapers. The slow coils 414 are cooled by adjacent water lines, not shown, incorporated into the structure 30 supporting the cathodes 412 and the slow coils 414. The main portion of the MAP structure shown in this Figure is about 18 cm high and wide. The complete MAP ion diode can be visualized as the revolution of the cross-sectional detail of FIG. 2 about the central axis 400 of the device to form a cylindrical apparatus. A full cross sectional view appears in FIG. 3.

The ion beam or MAP source 25 operates in the following fashion: a fast gas valve assembly 404 located in the anode assembly 35 produces a rapid (200 $\mu$s) gas puff which is delivered through a supersonic nozzle 406 to produce a highly localized volume of gas directly in front of the surface of a fast driving coil 408 located in an insulating structure 420. The nozzle is designed to prevent any transverse flow of non-ionized gas into the gap between the anodes 410 and cathodes 412. After pre-ionizing the gas with a 1 ms induced electric field, the fast driving coil 408 is fully energized from the fast capacitor 150, inducing a loop voltage of 20 kV on the gas volume, driving a breakdown to full ionization, and moving the resulting plasma toward the anode electrodes 410 in about 1.5 =82 s or less, to form a thin magnetically-confined plasma layer. The plasma momentarily stagnates at this B=0 region, the separatrix, next to the insulating field S produced by the slow coils 414, awaiting the delivery of the main accelerating positive electrical pulse to be delivered at the anodes 410 from the LIVA discussed above.

Figure 2C:
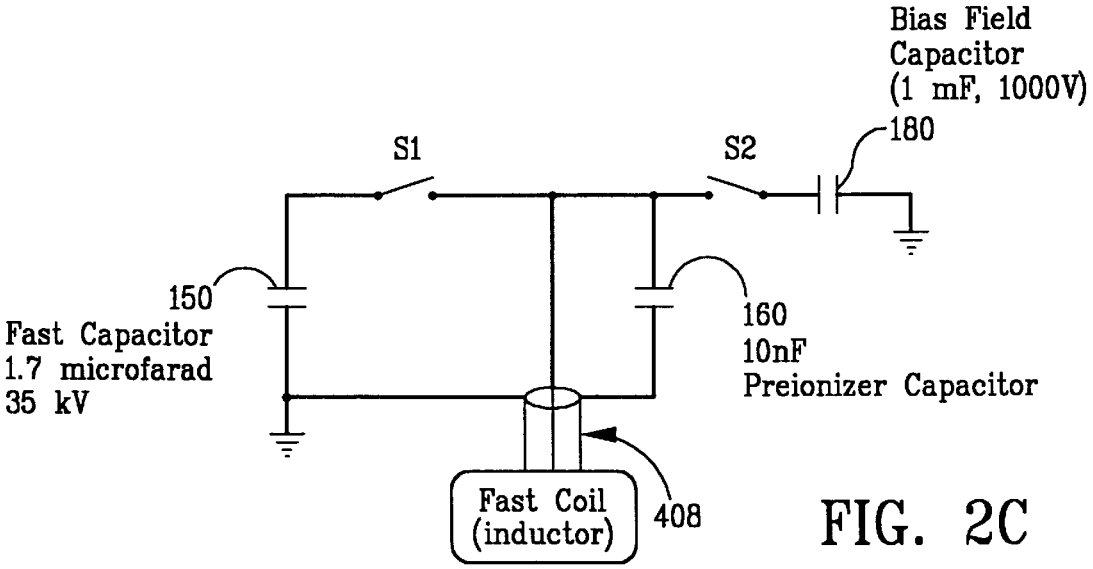
FIG. 2C is a schematic diagram of the electric circuit for the fast coil.

The pre-ionization step is a departure from the earlier MAP reference which showed a separate conductor located on the face of a surface corresponding to the insulating structure 420 herein. Since this conductor was exposed to the plasma, it broke down frequently. It was discovered that the separate pre-ionizing structure was unnecessary. The gas can be effectively pre-ionized by placing a small ringing capacitor 160 in parallel with the fast coil. The field oscillations produced by this ringing circuit pre-ionize the gas in front of the anode fast coil. A schematic electrical diagram of this circuit is shown in FIG. 2C.

It has also been demonstrated that, prior to provision of the main pulse to the fast coil, it is beneficial to have the ability to adjust the configuration of the magnetic field in the gap between the fast coil and the anode to adjust the initial position of plasma formation in the puffed gas pulse prior to the pre-ionization step. This is accomplished by the provision of a slow bias capacitor 180 and a protection circuit both being installed in parallel with the fast coil and isolated therefrom by a controllable switch S2. A slow bias field is thus created prior to pre-ionization of the gas by the fast coil.

After pre-ionization the fast coil is then fully energized as described above to completely breakdown the gas into the plasma. After this pulse the field collapses back into the fast coil which is connected to a resistive load which is in turn connected to a heat sink, not shown. In the present embodiment, cooling channels in the supporting structure are used, but other solutions are possible and relatively straightforward. In this manner heat build up in the fast coil is avoided.

The pulsed power signal from the power system is then applied to the anode assembly 35, accelerating ions from the plasma to form an ion beam. The slow (S) and fast (F) magnetic flux structures, at the time of ion beam extraction, are shown in FIG. 2A. The definite separation between the flux from the fast coil from the flux from the slow coil is shown therein. This is accomplished by the flux-shaping effects of the anodes 410 and also by the absence of a slow coil located in the insulating structure 420 as was taught in the earlier MAP reference paper. The slow coils in the present MAP ion diode are located only in the cathode area of the MAP. This design allows the B=0 point (the separatrix) to be positioned near the anode surface, resulting in an extracted ion beam with minimal or no rotation. This property is required for effective delivery of the beam.

The MAP ion diode described above is distinguished from prior art ion diodes in several ways. Due to its low gas load per pulse, the rate of vacuum recovery within the MAP allows sustained operation up to and above 100 Hz. As discussed above, the magnetic geometry is fundamentally different from previous ion diodes. Prior diodes produced rotating beams that were intended for applications in which the ion beam propagates in a strong axial magnetic field after being generated in the diode. The present system requires that the ion beam be extracted from the diode to propagate in field-free space a minimum distance of 20–30 cm to a material surface. The magnetic configurations of previous ion diodes are incapable of this type of operation because those ion beams were forced by the geometries of those diodes to cross net magnetic flux and thus rotate. Such beams would rapidly disperse and be inefficient for the present purposes. Moving the slow coils (the diode insulating magnetic field coils) to the cathode side of the diode gap eliminated the magnetic field crossing for the beam.

The design of the fast coil yields energy efficiency 5–10 times greater than exhibited in previous configurations. The modifications include: the elimination of a slow coil on the anode side of the diode and its associated feeds, better control over the magnetic field shaping and contact of the anode plasma to the anode electrode structure through use of the partially field-penetrable electrodes, the elimination of the separate pre-ionizer coil from the prior ion diodes, the circuit associated with the fast coil to provide "bias" current to adjust the magnetic field to place the anode plasma surface on the correct flux surface to eliminate beam rotation and allow optimal propagation and focusing of the beam, and the redesign of the gas nozzle to better localize the gas puff which enables the fast coil to be located close to the diode gap which in turn reduces the energy requirements and complexity of the fast coil driver.

The plasma can be formed using a variety of gas phase molecules. The system can use any gas (including hydrogen, helium, oxygen, nitrogen fluorine, neon, chlorine and argon) or vaporizable liquid or metal (including lithium, beryllium, boron, carbon, sodium, magnesium, aluminum, silicon, phosphorous, sulfur, and potassium ) to produce a pure source of ions without consuming or damaging any component other than the gas supplied to the source. As described, the ions will be singly ionized in the accelerator, but the MAP diode can be adapted to supply more power in the ionization cycle to produce multiply ionized ions, thus giving higher ion energies for a given accelerating voltage. The ion beam propagates 20–30 cm in vacuum ($\sim 10^{-3}$) to a broad focal area (5–1000 $cm^2$) at the target plane 195, shown in FIG. 3, where targets are placed for transmutation.

The MAP ion diode and the RHEPP source are the essential components of the RHEPP/MAP pulsed ion beam generator system. Such a system is capable of high average power and repetitive operation over an extended number of operating cycles for assisting deposition over large surface areas of materials at commercially attractive costs.

The description of the present invention, methods, apparatus, and products of transmutation of atomic nuclei, is presented in terms of a RHEPP/MAP ion beam generator system. However, the present invention need not be based on this class of ion beam generation systems, and is intended to be limited only by the description of the physical requirements for the present invention and by the claims appended to this description.

Having established that the proposed transmutation technique has real utility, the problem of heat dissipation in the target material, which will arise in any rapidly repetitively pulsed transmutation system, must be solved. Given an accelerator having the general operating characteristics of a 1 MW RHEPP/MAP system, two problems concern temperature of the target. The target must be able to dissipate the portion of the average beam power absorbed without requiring operation at an unacceptably high temperature. Also, the near-surface region of the target which absorbs the energy from an ion beam pulse must be able to dissipate that thermal energy without experiencing too great a transient temperature increase.

Consider the $^{99}$Mo synthesis described above. The range of the deuteron beam in the target material is ~0.3 g/$cm^2$, or about 300 microns. The total deposited energy density of the deuteron pulse is about 100 J/$cm^2$ (a value which can be altered by changing the focus of the MAP diode). The apparatus thus deposits about 300 J/gm of target material over a time period of ~100 nsec. The average high-T specific heat of Mo is ~0.4 J/gm° K., suggesting that the surface of the target rises in temperature some 750° K. during the beam pulse. This is acceptable in this case, as Mo has a high melting point and the surface will not melt or vaporize at this level of temperature rise unless the average temperature is too high.

The RHEPP/MAP design outlined above operates at 120 pulses per second. The average temperature of the irradiated surface layer will increase continuously unless the time constant for heat removal from this surface layer is substantially less than 10 msec. If the target is a thick piece of Mo, satisfying this constraint is not a problem. The average high-temperature thermal conductivity is on the order of 1 W/cm−° K. The time scale for thermal conduction is $$\Delta t \sim c\rho l^2/\kappa,$$

where c is the specific heat, ρ is the material density, κ is the thermal conductivity, and l is a length scale over which conduction is to occur. Substituting the variables and setting the time scale to 10 msec, one finds that heat from a pulse at the surface will travel some 500 microns into the body of the target before the next pulse arrives, thus reducing the temperature rise near the surface to about 280° K. Integrating the net effect of a large number of such pulses, the temperature rise at the surface of the target will be on the order of 1200° K. above the mean temperature of the target itself. This level of heating is acceptable in this case provided that the mean temperature of the target remains below about 2500° K.

The high mean temperature of the target results from the need to dissipate a megawatt of thermal power. To obtain a mean temperature rise at the front surface of ~1000° K. using a solid target, it is necessary for the target structure to be no more than about 1 mm thick, and for the back surface of the target to be cooled to near room temperature. This is a very difficult proposition, although it may be attempted by placing a forcibly cooled finned structure in contact with the back surface. If the effective cooling surface can be increased by a factor of 10 (a reasonable proposition), the target can be ~1 cm thick, and probably capable of withstanding the thermal stresses it will be subjected to by the transmutation process.

There is another approach to target cooling which allows a minimum of target material to be used and provides effective cooling. It is based on the observation that, for a properly designed pulsed transmutation process, most of the transmutation yield will accumulate as the top 5–7 MeV of beam energy is absorbed, while the remainder of the beam, having been slowed by interaction with the electrons of the target, is nearly useless for purposes of transmutation. It is therefore possible to configure the active target as a thin foil, whose thickness is perhaps ⅓ or ¼ of the total range of the ions. This foil then absorbs an average power of about 300–400 kW, while the rest of the beam power is dumped into a heat sink positioned behind the foil.

This arrangement has several advantages. First, the specific activity of the target is maximal, reducing the need for subsequent isotope separation. Although the transient temperature rise associated with the absorption of a beam pulse is about the same, the foil itself is only required to absorb about ⅓ of the total beam energy. The design of the heat sink can be optimized with respect to materials and structure (for example, pyrolytic graphite has a thermal conductivity some 10–15 times greater than Mo along its crystal planes). Such a design will significantly reduce the maximum temperature to which the foil is subjected, allowing a larger group of materials to be irradiated in this manner. The foil must be thermally anchored to the heat sink, as the power involved is too great to remove through the edge of the foil without unacceptable temperature rise. Such thermal anchoring is relatively straightforward. However, the thermal conductivity of the sample must be on the order of or larger than 0.01 W/cm° K. for the heat from one pulse to have time to penetrate into the heat sink before the next pulse arrives. This technique is thus compatible with virtually all solid materials of interest. However, some insulators, such as fused silica, polymers (indeed, organic materials in general), and gaseous targets will not satisfy the thermal conductivity criterion. As a result, the temperature of the target will continue to increase as more ion beam pulses interact with it, despite excellent contact with the heat sink, until the target breaks down in some manner.

The above discussion of heat management in the pulsed transmutation process suggests that, even though the simple cooled solid or foil target approach can be used on many materials having reasonably high melting temperatures (perhaps in excess of ~2000° K.), there remain a wide range of target materials which are not appropriate for this approach toward cooling. Especially, materials having either low melting temperatures or low thermal conductivity would encounter great difficulty in a pulsed transmutation system where they are expected to survive exposure to 100 J/$cm^2$ pulses at a rep rate of 120 pps. The energy density of the pulses can be reduced somewhat by defocusing the beam, and the rep rate can be reduced (both reducing the transmutation yield), but eventually other approaches to the design of targets must be developed to obtain a truly general-purpose pulsed transmutation system.

Consider the case of synthesis of $^{123}I$ from $^{122}Te$, described earlier. Te has a melting point of 450° C. and a boiling point of 988° C., so is not compatible with the target cooling technologies described above. A further problem is presented by the extremely low boiling point of iodine (185° C.), which would allow some of the transmuted atoms to diffuse to the surface of the target and boil off. However, it is important to remember that physical form has little to do with the transmutation process, save that the ions must be able to interact effectively with the target material and the transmuted atoms must be recoverable.

There are a number of possible approaches to the problem of a low melting point. The most obvious is to direct the ion beam downwards, and allow the beam to form a puddle of liquid material in the center of the target. When materials are used having a wide spread between melting and boiling points, this approach may work well, provided that the product atoms have small enough vapor pressure that they are contained within the target material. With some materials it still may not be possible to use the desired 100 J/cm$^2$ deposited energy density in this approach. E.g., the production of $^{123}I$ outlined above may not be a candidate for this containment/cooling technique unless the deposited energy density is reduced by a factor of 3–4. However, there are many systems and reactions for which the puddle technique can be used where the thin foil technique cannot.

Another approach to the problem of handling the beam power is to form a high-temperature compound of the material one wishes to use as a target. If an aluminium target were used at 100 J/cm$^2$ beam pulse energy, an aluminium thin film would not survive the experience. However, if the thin film were made of sapphire, there would be no problem in withstanding the thermal loading. The transmutation yield would be reduced by a factor of about ⅖ (2 Al atoms per $Al_2O_3$ molecule), but the high average beam currents allow such a loss to be acceptable. Clearly, there are a limited number of materials suitable for this approach, and it is often associated with the production of undesired radioactive wastes.

A final approach for using the present invention on a target material of low melting point and/or low thermal conductivity is to form a composite target from a mixture of the desired target material and a filler which has high melting point and high thermal conductivity. If the volume fraction of the filler is greater than the percolation threshold (perhaps ~85%), there will be continuous filaments of the filler material spanning the composite sample. If the particles of filler and the target material are small enough, heat will quickly pass from the target material into neighboring filler material, and then be transported quickly to the surface of the composite sample. The payment for this technique is low transmutation yield of the desired material, because some 85% of the reactions will take place in the filler, but the technique does allow the current transmutation techniques to be used on thermally sensitive samples.

If a truly general-purpose transmutation system is desired, irradiation of gaseous samples must be possible. The idea is to construct an irradiation cell in which a gaseous material is held and exposed to the ion beam pulses. Such a cell must clearly have a thin window to allow passage of ions. As a typical range for the ions of use in low-energy transmutation is 0.114 0.5 gm/cm$^2$, the areal density of the window material must be <<0.1 gm/cm$^2$. Potential window materials must retain strength at reasonably high temperatures and not be expected to produce long-lived radioisotopes under irradiation. Such might include Al alloys, Inconel, high-T stainless-steel, Ta, W, and the like. A typical window thickness would be ~20–40 $\mu$m. If such a window is not strong enough for the application, a reinforcing grid may be used to help support the window which blocks a minimum of the incoming ion beam pulses. Possible materials for the reinforcing grid would include ceramic-carbon fiber composites and dense refractory metals.

What happens to the heat deposited by the ion beam pulses in a gaseous cell? A small amount of power is deposited in the front window, but typically some ~⅓ (more generally, 15–50%) of the total beam power should be deposited in the gaseous sample itself. The remainder will be deposited in the rear wall of the cell, which will be composed of a material having high thermal conductivity, or directly into the heat sink.

Consider the reaction $^{14}N$ (d,n)$^{15}O$, which has a cross section of about 0.1 barn at about 7 MeV. $^{15}O$ is a positron emitter with a short half-life (2 minutes) which is widely used in positron emission tomography (PET) studies. There are numerous reasons to run this reaction with a gaseous target, among which is the ease of chemically separating the $^{15}O$ produced. The beam energy used would be about 10–12 MeV to allow some energy to be lost in the cell window. To obtain the typical 0.1 gm/cm$^2$ density associated with deuteron reactions in this energy range, some 10 grams of target material must be confined in the target cell, or ~0.35 gram-moles of $N_2$ gas. At STP this much gas will occupy ~8000 cm$^3$ of volume, suggesting that the target cell must be about 80 cm in thickness. For convenience and to avoid problems of beam focusing, however, the nitrogen gas would probably be under a pressure of several atmospheres, reducing the cell thickness to ~10 cm. Such a pressure should be easily contained by the window film.

A suitable gaseous target cell can be constructed to hold a sufficient quantity of gas before irradiation starts, but what happens when the ion beam pulses begin? Some 30–40 J/cm$^2$ is absorbed by the gas in a single ~100 nsec beam pulse, more or less uniformly throughout the volume of the gas. The pulses arrive at a rate of 120 pps, meaning that the average power absorbed by the gas is ~400 kW. How must the target cell be designed to absorb this heat and withstand the pressure of the heated gas?

First, it is relatively easy to show that a simple sealed cell is not a good choice. A single ion beam pulse raises the temperature of the irradiated gas by about 400° K., roughly doubling the original pressure in the target cell. This in itself could be handled by proper design. However, the next question concerns the removal of this heat from the gas in the cell before the next ion beam pulse arrives ~10 msec later. A simple calculation shows that less than about 0.1 J/cm$^2$ can be removed from the target gas through thermal conduction in the available time between pulses. Convective and, eventually, radiative cooling will significantly increase this value, but is unlikely to provide the three orders of magnitude increase required at reasonable temperatures. Accordingly, the gas in a simple sealed target cell will increase in temperature and pressure as more ion beam pulses are absorbed, until the cell either explodes or melts.

How can this problem be overcome? It is not possible to place cooling structures in the irradiation volume, as they would absorb an unacceptable portion of the beam ions, thus lowering yield while increasing the thermal loading on the gaseous target cell. However, the gas being irradiated need not always be the same gas. This leads to the idea of using active or passive mechanisms which transfer and cool the irradiated gas after each pulse, replacing the irradiated gas with cooler gas so that the cell is in readiness for the next pulse of ions.

Consider first a simple passive cell which addresses the gas heating problem. The irradiation volume in the simple sealed cell is 100 $cm^2$in cross sectional area and 10 cm long. Construct a cell with the same irradiation volume but a total cross sectional area of, e.g., 10000 cmand a length of 10 cm. The ion beam pulse still irradiates only 100 $cm^2$ of the cross sectional area of the cell. (Remember that if the target material is not gaseous at room temperature, the entire cell must be heated to above the boiling temperature of the target material so that it does not condense out in a region not accessible to the ion beam pulses.)

When the ion beam pulse hits, the gas in the irradiation volume essentially instantaneously doubles in both temperature and pressure. (It is easy to show that the irradiated gas remains in its original volume during the irradiation process. A typical speed of sound in a gas at 10 atmospheres is on the order of 500 m/sec. The material velocity in the shock wave set up by the mild overpressures associated with absorption of a single ion pulse will be much less than this value, perhaps 100 m/sec. In the 100 nsec duration of irradiation by the pulsed ion beam, the irradiated gas will be able to move <10 $\mu$m. Thus, during a single ion beam pulse, substantially all the gas which begins in the irradiation volume stays there.)

After the ion beam pulse ends, the irradiated gas expands outward into the remainder of the volume of the cell. On mixing with the surrounding gas, the irradiated gas cools. This mixing can be increased in effectiveness by placing structures immediately surrounding the irradiation volume which are designed to swirl the outcoming gas and increase turbulent mixing of the hot gas and the cool gas. The region of the cell which is not exposed to the ion beam pulses can also contain devices for external cooling of the gas, such as finned tubes through which a coolant flows. (Remember, even though the problem of recovering from a single ion beam pulse is accomplished through this type of design, the gas in the cell is absorbing some 300–400 kW from a 1 MW ion source, which heat must be removed from the cell.) When the hot gas cools off, or is trapped outside the irradiation volume by the flow of cool gas therein, the irradiation volume backfills with cool gas, and is ready to receive another ion beam pulse. The cell size and gas velocities expected make this a reasonable design for a repetition rate of ~100 pps. On the down side, ~100 times more sample material are needed (typically 1 kg instead of 10 gms), but this is rarely a problem with gaseous targets, unless they are isotopically enriched.

A modification of this idea which is more complex, but requires less target material, involves construction of an asymmetric sample cell. Consider a sample cell having a cross sectional area of 100 $cm^2$ and a length of 10 cm. This cell is not sealed, but has an input and an exhaust manifold. The cross section of the input manifold is much smaller than that of the exhaust manifold. As a result, when an ion beam pulse heats the target gas, it will almost entirely expand into the exhaust manifold, because of the large difference in conductance between the input and exhaust structures. Again, the target gas mixes with the cooler gas in the exhaust manifold, rapidly reducing the overpressure. The gas in the exhaust manifold is pumped back into the input manifold following passing through a cooling stage, which removes the excess heat resulting from the irradiation from the system. The cooled gas then fills the target cell, and the system is ready for another ion pulse. Such a system could be implemented with mechanical valves sealing off the manifolds at appropriate times, but this considerable increase in complexity should result in very little improvement in function. Such a system might function with ~100 gm of target gas, a considerable improvement over the totally passive cell.

Both of the above propositions for target cells are based on a pulsed mode of operation, i.e., they are actuated by the overpressure resulting from irradiation by an ion beam pulse. It is also possible to consider a continuous flow system, in which the localized overpressures resulting from the irradiation process are small perturbations. Such a system would essentially be a wind tunnel, in which the input and output are connected. The velocity of the gas in the tunnel would sweep the irradiated gas out of the irradiation volume before the next ion beam pulse is applied. This requires a velocity of a few tens of meters/second, which does not pose a significant design problem. As in the prior example, the return loop will have to include a cooling system to remove the average 300–400 kW heat load from the gas. Such systems are well within the state of the art.

It has been shown above that the problem of heat management for almost any target material subjected to repeated ion beam pulses in the 100 J/$cm^2$ range with an average power of ~1 MW can be solved by proper design of the target and its associated structures.

The potential classes of applications for the transmutation processes described above are now outlined. First consider the straightforward bombardment of targets with energetic light ions (Z~1–6). The highest yield of product will generally result from the synthesis of neutron-poor isotopes. This is partially because the light beam ions are neutron-poor compared to most heavier isotopes, and also because reactions in which neutrons are emitted from either from the ion capture process or from the breakup of the intermediate nucleus are often of quite high yield.

Although the products of such reactions are useful in a wide range of applications, perhaps nuclear medicine is the application which is currently undergoing the most rapid development, and which is feeling the lack of sources of radioisotopes most painfully. The three examples outlined above (synthesis of $^{99}$Mo, $^{123}$I, and $^{15}$O) are all of interest primarily in nuclear medicine; $^{99}$Mo as an agent for nuclear imaging, particular in cardiology, $^{123}$I as an implantable tumor treatment agent, and $^{15}$O as a source for positron emission tomography (PET) studies. These isotopes are all of particular current interest, but on the order of 100 radioisotopes have been identified as of interest for nuclear medicine, with applications ranging from metabolism tracer studies to a wide range of imaging modalities to direct treatment of various sorts of cancer. The direct syntheses made possible by use of an RHEPP/MAP-type accelerator in a properly designed transmutation apparatus allow routine production of more than half of the nuclei of medical interest. Moreover, production of the amounts required is generally quick and easy.

As mentioned above, the product of direct reactions are generally somewhat neutron-poor. It is therefore important to find ways of adding neutrons to target nuclei. There are a number of possible techniques, each of which has its own realm of usefulness. The (d,p) reaction can be used over the entire range of the periodic table at RHEPP/MAP beam energies with significant yields, and, because of the long range of deuterons in matter, is probably the best technique of this sort. ($\alpha$,p) reactions are also possible, which again add net neutrons to the target nuclei, but such reactions have reasonable yield at RHEPP/MAP beam energies only for target atomic masses in the range of about 40–65. The third method is indirect. If one creates an isotope which is short-lived, has the same atomic mass as the desired product but an atomic number one larger, and which decays by positron emission, one of the protons in the nucleus will turn into a neutron, giving a secondary product which might not be accessible through direct reaction.

Another possibility is to use the technique of transmutation using high intensity repetitively pulsed accelerators to generate pulses of neutrons, and use the neutrons thereby generated to produce transmutations in secondary targets. The yield of the (d,n) reaction increases rapidly as the mass of the target nuclei decrease below about 20. To maximize neutron production, a solid target capable of withstanding and dissipating high power densities is probably best. This allows not only production of a large number of nuclei, but also of irradiating a small target area so that the density per $cm^2$ of neutrons available at secondary target locations is maximized. Two particularly appropriate materials are Be and $B_4C$. (Appropriate both because of high neutron yield and the ability to withstand high temperatures. Other targets which are well known in the art include $ErD_2$, $ErT_2$, and a Ti/Pd alloy loaded to near solid densities of D or T.) When irradiated with 10 MeV deuterons, the neutron production yield is ~0.6% and ~0.4% respectively. When irradiated in an accelerator supplying an average beam current of 100 ma, the production rate of neutrons is a few$\times 10^{15}$ per second. These neutrons will have energies typically of 1–3 MeV. As the environment in a nuclear reactor is on the order of $10^{13}$ neutrons/sec/$cm^2$, the RHEPP/MAP-based neutron source is clearly very powerful. More significant for some applications, however, is the extremely high dose rate during the pulses themselves. The production rate during the ion pulse is about $10^{20}$ neutrons/second, a value essentially unobtainable outside of a nuclear device. Operation of an RHEPP/MAP-type transmutation device as a neutron source is clearly another practical and useful option.

It is possible to use the present process to synthesize transuranic elements. For example, the reaction $^{238}U$ ($\alpha$,2n) $^{240}Pu$ has a cross-section of about a barn at a beam energy of 20 MeV. Many other reactions depend on the use of heavy ions, which at the beam energy available using a RHEPP/MAP accelerator generally have very small cross-sections for reaction. The heavy ions become more interesting if the MAP diode is reconfigured to produce multiply ionized plasma. For example, given triply ionized carbon, the reaction $^{238}U$ ($^{12}C$, 4n) $^{246}Cf$ becomes accessible to a RHEPP/MAP-type accelerator, having a cross-section of about $2\times 10^{-5}$ barns. (The yield is small because of the competition with other reactions, primarily fission.) The amounts of transuranics which can be produced in such a modified RHEPP/MAP system are small but significant.

Much of the above discussion has been in terms of an RHEPP/MAP accelerator system and with reference to specific nuclear reactions. These are meant only as examples, and are not intended to limit the scope of the present invention, which is defined only by the claims below. In these claims, the term "rapidly repetitive" refers to a sustained pulse rate greater than 1 pulse per second, "high average currents" refers to average ion beam currents greater than about 10 milliamps, and "high power" refers to average ion beam power greater than about 1000 watts.

We claim:

1. An apparatus for transmutation of target isotopes, comprising:

a) a source of rapidly repetitive high average current ion beam pulses, wherein the average power of said ion beam pulses is greater than about 1 kilowatt;

b) a target for said ion beam pulses comprising said target isotopes and so positioned that said ion beam pulses interact with said target isotopes; and c) means for cooling said target.

2. An apparatus for transmutation of target isotopes, comprising:

a) a source of rapidly repetitive high average current ion beam pulses, wherein the ion kinetic energy of said ion beam pulses is greater than 5 MeV;

b) a target for said ion beam pulses comprising said target isotopes and so positioned that said ion beam pulses interact with said target isotopes; and c) means for cooling said target.

3. The apparatus of claim 1, wherein the ion kinetic energy of said ion beam pulses is greater than 50 keV.

4. The apparatus of claim 1, wherein said source of rapidly repetitive ion beam pulses is an RHEPP/MAP-type accelerator.

5. The apparatus of claim 1, wherein said ion beam pulses consist essentially of ions chosen from the group consisting of: ionized H, ionized D, ionized T, ionized O, ionized He, ionized N, ionized F, and combinations thereof.

6. The apparatus of claim 1, wherein the each pulse of said source of repetitive ion beam pulses is of less than 10 ns duration.

7. The apparatus of claim 1, wherein said target comprises isotopically enriched material.

8. The apparatus of claim 1, wherein said target comprises a refractory compound of the target isotope.

9. The apparatus of claim 1, wherein said target comprises a foil, said foil being oriented with its thin dimension substantially parallel to the direction of travel of the ion beam pulses, said foil further comprising the target isotopes, the thickness of said foil being smaller than the average range of the ion beam pulses in the material of which said foil consists.

10. The apparatus of claim 1, wherein said target comprises a mixture of high and low thermal conductivity materials formed into a composite, such that the high thermal conductivity material makes continuous paths across said composite and that the low thermal conductivity material comprises said target isotopes.

11. An apparatus for transmutation of target isotopes, comprising:

a) a source of rapidly repetitive high average current deuteron ion beam pulses;

b) a neutron source target, said neutron source target to be irradiated by said deuteron ion beam pulses, thereby producing neutrons;

c) means for cooling said neutron source target, and;

d) a secondary target comprising said target isotopes exposed to said neutrons.

12. The apparatus of claim 11, wherein said source of deuteron ion beam pulses is an RHEPP/MAP-type accelerator system.

13. The apparatus of claim 11, wherein the kinetic energy of said deuteron ion beam pulses is greater than 50 keV.

14. The apparatus of claim 11, wherein the average beam power of said rapidly repetitive deuteron ion beam pulses is greater than 1 kW.

15. The apparatus of claim 11, wherein the neutron source target comprises a neutron source target mount and a neutron source target material.

16. The apparatus of claim 15, wherein said neutron source target material comprises Be, $B_4C$, C, D, $D_2O$, T, $ErD_2$, $ErT_2$, $Ti/Pd_x$, $Ti/PdT_x$ or combinations thereof.

17. The apparatus of claim 11, further comprising a neutron moderator placed between the neutron source target and the secondary target.

18. The apparatus of claim 3, wherein said source of rapidly repetitive ion beam pulses is a RHEPP/MAP-type accelerator.

19. The apparatus of claim 3, wherein said ion beam pulses consist substantially of ionized H, D, T, O, He, C, N, F, or combinations thereof.

20. The apparatus of claim 3, wherein the sustained repetition rate of said source of repetitive ion beam pulses is greater than 10 pulses per second.

21. The apparatus of claim 3, wherein said target comprises isotopically enriched material.

* * * * *